United States Patent [19]

Ii

[11] Patent Number: 4,824,391

[45] Date of Patent: Apr. 25, 1989

[54] CONNECTOR FOR FLAT FLEXIBLE CIRCUIT MEMBERS

[75] Inventor: Hidehiro Ii, Yokohama, Japan

[73] Assignee: Molex Incorporated, Lisle, Ill.

[21] Appl. No.: 111,951

[22] Filed: Oct. 23, 1987

[30] Foreign Application Priority Data

Nov. 28, 1986 [JP] Japan ..... 61-183292[U]

[51] Int. Cl.[4] ..... H01R 23/66

[52] U.S. Cl. ..... 439/329; 439/67; 439/77

[58] Field of Search ..... 439/67, 77, 329, 492, 439/493

[56] References Cited

U.S. PATENT DOCUMENTS 3,629,787 12/1971 Wilson ..... 439/67
4,379,608 4/1983 Olsson et al. ..... 439/329
4,684,183 8/1987 Kinoshita et al. ..... 439/77

*Primary Examiner*—Steven Mottola

*Attorney, Agent, or Firm*—John W. Cornell; Louis A. Hecht

[57] ABSTRACT

A connector is provided for joining two flat flexible cables. The connector comprises a carrier having an elongated base, a pair of guides extending orthogonally from opposed ends of the base and a generally planar support extending from the base and disposed between the guides. The connector further comprises a resilient clip having opposed arms extending from a connecting member and converging toward one another. Slits may be formed in the clip to define a plurality of independent clamping fingers aligned respectively with conductive traces on the flat flexible circuit members. The circuit members are disposed in face to face contact on the support of the carrier, and the clip is slidably advanced over the circuit members and the support. Thus, the arms of the clip hold the flat flexible circuit members in face to face contact with one another and against the support of the carrier.

18 Claims, 3 Drawing Sheets

CONNECTOR FOR FLAT FLEXIBLE CIRCUIT MEMBERS

BACKGROUND OF THE INVENTION

Flat flexible circuit members, such as flat flexible cables, are widely employed in electrical and electronic devices. The typical flat flexible circuit member is an elongated flexible structure having a width many times greater than its thickness. A plurality of electrically conductive traces extend in a parallel array along the length of the flat flexible circuit member, and an insulating web supports and protects the conductive traces. The insulating web may be disposed along one or both sides of the electrically conductive traces. Means are provided for exposing the electrically conductive traces at selected locations. For example, the protective and insulating web may be removed adjacent one end of the flat flexible circuit member to expose the electrically conductive traces and to enable the flat flexible circuit member to be mechanically and electrically mounted to a connector.

Flat flexible circuit members typically extend from one electrical connector to another. The electrical connectors in turn are mounted on printed circuit boards or the like. The prior art connectors used with flat flexible circuit members have been fairly complex and costly. More particularly, the prior art connectors for flat flexible circuit members have required a precisely manufactured housing in which a plurality of separate electrically conductive contacts are securely mounted. The housing of the prior art connector typically includes a slot precisely dimensioned to receive the flat flexible circuit member. The electrically conductive contacts are disposed in the housing to be urged against the conductive traces on the flat flexible circuit member upon insertion of the flat flexible circuit member into the slot.

Many prior are connectors for flat flexible circuit members include a housing having members which are movable to urge the contacts and the flat flexible circuit member toward one another. Examples of these types of prior art connectors include the many known zero insertion force connectors which permit the flat flexible circuit member to be easily inserted into an open slot in the housing, and then which move members relative to one another to achieve the required electrical connection.

One example of an electrical connector for flat flexible cables is shown in U.S. Pat. No. 3,158,421 which issued to Hasenauer on Nov. 24, 1964. The connector shown in U.S. Pat. No. 3,158,421 is specifically intended to connect a circuit board to a flat flexible cable and to other circuit members. More particularly, the connector of U.S. Pat. No. 3,158,421 includes a rectangular housing having a central rectangular opening therein. A plurality of spring contact members are disposed in the rectangular opening. The opening is dimensioned to receive an edge of the circuit board with the flat flexible cable effectively folded over the circuit board edge. This combination of the circuit board and the folded flat flexible cable is inserted into the slot and is retained in that inserted position by a cover plate having a pair of retaining clips at each end. The rectangular housing securely holds the flat flexible cable against the edge of the circuit card. Thus, the conductors on the flat flexible cable make contact with the terminals on the circuit board and with the spring contacts in the housing.

Another prior art electrical connector for a flexible circuit is shown in U.S. Pat. No. 3,843,951 which issued to Maheux on Oct. 22, 1974. The connector shown in U.S. Pat. No. 3,843,951 is specifically intended to connect a circuit board or an IC package to a flat flexible cable. The connector of U.S. Pat. No. 3,843,951 includes a resilient support member having an opening formed in one surface. The opening is dimensioned to biasingly receive the circuit card or IC package with the flat flexible cable wrapped thereabout.

U.S. Pat. No. 3,923,364 which issued to Shapiro et al on Dec. 2, 1975, shows still another apparatus for making electrical connection with a flat flexible cable. The apparatus of U.S. Pat. No. 3,923,364 includes a base having a centrally disposed anvil over which a flat flexible cable may be disposed. An upper housing also is provided with a plurality of generally U-shaped electrical contacts disposed therein. The arms of the U-shaped contacts are dimensioned to biasingly extend over both the anvil and the flat flexible cable which is folded over the anvil. The housing is constructed to guide the U-shaped contacts over the flat flexible cable and the anvil.

Still another prior art connector for flat flexible cables is shown in U.S. Pat. No. 3,696,319 which issued to Olsson on Oct. 3, 1972. The connector of U.S. Pat. No. 3,696,319 is very similar to the previously described U.S. Pat. No. 3,923,364 in that the flat flexible cable is draped over an anvil-like structure, and the combination of the anvil and the flat flexible cable is urged between the arms of a U-shaped electrical contact. The U-shaped electrical contacts of U.S. Pat. No. 3,696,319 are mounted in a housing. Still another similar structure is shown in U.S. Pat. No. 4,136,917 which issued to Then et al on Jan. 30, 1979.

All of the above described connectors include precisely manufactured housings having electrical contacts mounted therein, and which are specifically constructed to achieve electrical connection between a flat flexible cable and the contacts mounted in the housing. These prior art structures are both complex and costly.

In view of the above, it is an object of the subject invention to provide an inexpensive yet reliable connector for electrically connecting a plurality of flat flexible circuit members to one another.

It is another object of the subject invention to provide an electrical connector for flat flexible circuit members that does not require any electrical contacts.

It is an additional object of the subject invention to provide a connector for flat flexible circuit members that is easy to manufacture and simple to use.

A further object of the subject invention is to provide a connector for flat flexible circuit members that can be used a plurality of times without damaging either the connector or the flat flexible circuit members mounted therein.

Still a further object of the subject invention is to provide a connector for flat flexible circuit members that achieves a secure and locked mating of the circuit members to one another with a minimum of moving parts.

SUMMARY OF THE INVENTION

The connector for flat flexible circuit members of the subject invention comprises a carrier and a clip. The carrier may be of unitary construction and may be injection molded from a plastic material. The carrier includes a pair of guides which are spaced from one another by a distance substantially equal to the widths of the respective flat flexible circuit members or cables to be joined. The guides may be mounted relative to one another to exhibit a controlled resiliency and preferably are disposed in parallel relationship.

The guides of the carrier may include locking means which are operative to enable a secure locked relationship between the carrier and the clip. The locking means may comprise at least one mating recess in at least one of the guides. Preferably, each guide is provided with at least one mating recess, with the respective mating recesses being disposed on the side of each guide facing the other guide.

The carrier further comprises a support disposed intermediate the respective guides. More particularly, the support preferably comprises a planar portion on which the flat flexible circuit members may be mounted. The support may include a leading edge extending orthogonal to the guides and disposed therebetween. The portion of the support adjacent the leading edge may be tapered. As explained in detail below, the support may be spaced from the guides.

The clip of the subject invention is of generally U-shaped cross section and may be of unitary construction. The clip may be formed from a resilient metallic material or from a resilient plastic material. The clip includes first and second opposed arms and a connecting member extending therebetween. The arms may converge toward one another as they extend away from the connecting member. However, the ends of the arms most distant from the connecting member may flare outwardly and away from one another. At their closest point, the first and second arms may be spaced from one another by a distance approximately equal to the thickness of the support on the carrier. At least the first arm of the clip has a width which approximately corresponds to the width of the flat flexible circuit members to be joined by the subject connector. Preferably, both arms of the clip have a substantially equal width which approximately equals the width of the flat flexible circuit member.

At least one of the arms of the clip may be provided with locking means which are engageable with locking means on the carrier. The locking means on the clip may comprise outwardly extending flanges which may be disposed in locking relationship with recesses on the guides of the carrier. In a preferred embodiment, a plurality of flanges may be disposed on at least one of the arms to enable the clip to be retained on the carrier in an unseated position and then to be locked in a fully seated position. The flanges may further define cams to bias the guides of the carrier away from one another and permit movement of the clip between the guides.

At least the first arm of the clip may include a plurality of slots extending generally orthogonal to the connecting member of the clip. The slots effectively define a plurality of independent clamping fingers on the arm. The clamping fingers of the first arm may include contact projections disposed substantially at a location on the first arm nearest the second arm of the clip.

The connector of the subject invention is employed by positioning exposed end portions of a pair of flat flexible circuit members in generally face to face relationship such that the conductive traces of one flat flexible circuit member are disposed respectively in contact with the conductive traces of the other flat flexible circuit member. The two flat flexible circuit members are disposed on the support of the carrier. The clip of the connector then is slidably advanced over the support of the carrier to securely hold the flat flexible circuit members in their face to face relationship and securely against the support of the carrier. More particularly, the resilient characteristics of the clip are such that the first and second arms are biased toward one another and against the flat flexible circuit members and the carrier support therebetween. Locking means of the carrier and the clip may securely but releasably hold the clip in this seated condition on the carrier.

The above described connector enables the carrier support and the resilient clip to contact only the insulating webs of the respective flat flexible circuit members. As a result, these connections can be made repeatedly without damaging the conductive traces on the flat flexible circuit members. In embodiments having the separate clamping fingers, secure contact pressure is achievable for each conductive trace on the flat flexible circuit members despite the possibility of discontinuities in the thicknesses of the insulating web or the possibility of foreign material being disposed on a portion of the connector or the flat flexible circuit members.

DETAILED DESCRIPTION OF THE PREFERRED EMBODIMENTS

Figure 1:
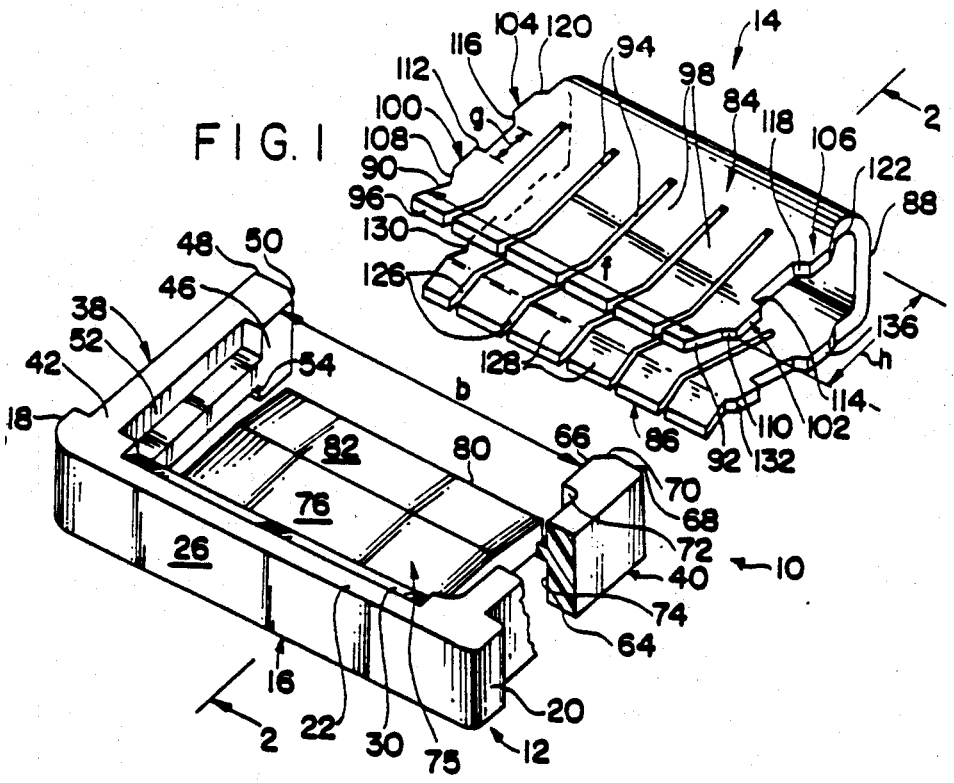
FIG. 1 is an exploded perspective view of the connector of the subject invention.

The connector of the subject invention is indicated generally by the numeral 10 in FIG. 1. The connector 10 comprises a carrier 12 and a resilient clip 14.

Figure 2:
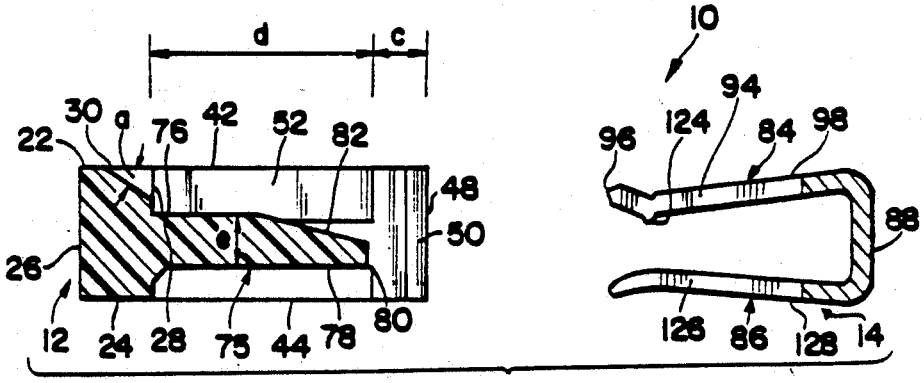
FIG. 2 is a cross-sectional view taken along line 2—2 in FIG. 1.

The carrier 12 is of unitary construction and is injection molded from a plastic material. More particularly, as shown in FIGS. 1 and 2, the carrier 12 includes an elongated base 16 having opposed ends 18 and 20, opposed top and bottom surfaces 22 and 24 extending between the ends 18 and 20, a rear surface 26 and a front surface 28. The base 16 further includes a chamfered cable alignment surface 30 extending between the top and front surfaces 22 and 28 and aligned to the top surface 22 at an angle "a" of between approximately 30° and 60° as shown in FIG. 2.

The carrier 12 further comprises first and second guides 38 and 40 extending from portions of the base 16 generally adjacent the first and second ends 18 and 20 respectively. More particularly, the guides 38 and 40 are substantially parallel to one another and substantially perpendicular to the base 16. The guides 38 and 40 extend generally from the front surface 28 of the base 16 and are disposed such that the chamfered cable alignment surface 30 is between the guides 38 and 40.

The guide 38 includes opposed top and bottom surfaces 42 and 44, and an inner surface 46. As shown most clearly in FIG. 1, the inner surface 46 of guide 38 defines the portion thereof facing the guide 40. The guide 38 further includes an end 48 and a cam surface 50 which intersects the inner surface 46 and the end 50 at an acute angle. The guide 38 further comprises an elongated locking recess 52 extending into the top surface 42 and the inner surface 46. Similarly, the guide 38 includes an elongated locking recess 54 extending into the bottom surface 44 and the inner surface 46. The locking recesses 52 and 54 are substantially identical in size and shape, and are generally symmetrical with one another on the guide 38.

The guide 40 is substantially a mirror image of the guide 38. More particularly, the guide 40 includes opposed top and bottom surfaces 62 and 64, an inner surface 66 and an end 68 and a cam surface 70. The guide 40 is further provided with an elongated locking recess 72 extending into the top surface 62 and the inner surface 66. Similarly, the guide 40 is provided with an elongated locking recess 74 extending into the bottom surface 64 and the inner surface 66.

The distance "b" between the inner surfaces 46 and 66 is substantially equal to the width of the flat flexible circuit members to be employed with the connector 10. The elongated locking recesses 52, 54, 72 and 74 begin at points spaced from the respective guide ends 48 and 68 by a distance indicated by dimension "c" in FIG. 2. Additionally, the elongated locking recesses 52, 54, 72 and 74 extend for a distance "d" along the respective guides 38 and 40. The distances "c" and "d" correspond to the distances of structural members on the clip 14 as explained further below.

The carrier 12 further includes a support 75 which extends from the front surface 28 of the base 16 and is disposed generally centrally between the guides 38 and 40. The support 75 includes opposed top and bottom surfaces 76 and 78 which are spaced from one another by distance "e" as shown in FIG. 2. The distance "e" is substantially less than the distance between the top and bottom surfaces 42 and 44 of the guide 38. The support 75 further includes a leading edge 78 which extends generally parallel to the base 16 and is spaced from the front surface 28 by a distance approximately equal to the length "d" of the locking recesses 52, 54, 72 and 74. The support 75 further includes a tapered surface 82 extending angularly between the top surface 76 and the leading edge 78. The support 75 is spaced from the guides 38 and 40, thereby permitting limited resilient movement of the guides 38 and 40 relative to one another and relative to the support 75.

The clip 14 of the connector 10 preferably is formed from a resilient metallic material. However, as noted above, a plastic which exhibits the required resilient characteristics could also be employed. The clip 14 is of generally U-shaped cross section as shown in FIG. 2, and includes opposed top and bottom arms 84 and 86 which extend from a connecting member 88 and converge toward one another for most of their lengths. Top and bottom arms 84 and 86 have a width "f" between side edges 90 and 92 substantially equal to or slightly less than the distance "b" between the guides 38 and 40 of the carrier 12.

The top arm 84 of clip 14 includes a plurality of elongated slits 94 extending inwardly from the leading edge 96 thereof most distant from the connecting member 88. The slits 94 define a plurality of independent clamping fingers 98 in the top arm 84. The number and spacing of the slits 94 is selected to ensure that a separate clamping finger 98 is provided for each conductive trace on the flat flexible circuit members to be employed with the subject connector 10.

The upper arm 84 includes a pair of leading locking flanges 100 and 102 respectively disposed on the opposite sides of the top arm 84. The top arm 84 further includes a pair of trailing locking flanges 104 and 106 disposed on the opposed ends of the top arm 84 and between the leading locking flanges 100, 102 and the connecting member 88. The leading locking flanges 100 and 102 comprise leading cam edges 108 and 110 respectively which extend angularly from the sides 90 and 92 of top arm 84, and trailing locking edges 112 and 114 which are perpendicular to the side edges 90 and 92. The trailing locking flanges 104 and 106 comprise leading cam edges 116 and 118 respectively and trailing cam edges 120 and 122 all of which are angularly aligned to the side edges 90 and 92. As will be explained below, the various cam edges of locking flanges 100–106 will cooperate with the cam surfaces 50 and 70 on guides 38 and 40 of carrier 12.

The locking flanges 100–106 all are dimensioned to be received within the locking recesses 52, 54, 72, 74 of the carrier 12. To ensure the proper cooperation between the carrier 12 and the clip 14, the distance "g" between the leading locking flanges 100, 102 and the trailing locking flanges 104, 106 is equal to or slightly greater than the distance "c" between the ends 48, 68 of the guides 38, 40 and the respective locking recesses 52, 54, 72 and 74. Additionally, the overall distance represented by the locking flanges 100 and 104 or 102 and 106, as indicated by dimension "h" is equal to or slightly less than the length "d" of the locking recesses 52, 54, 72 and 74.

Figure 3:
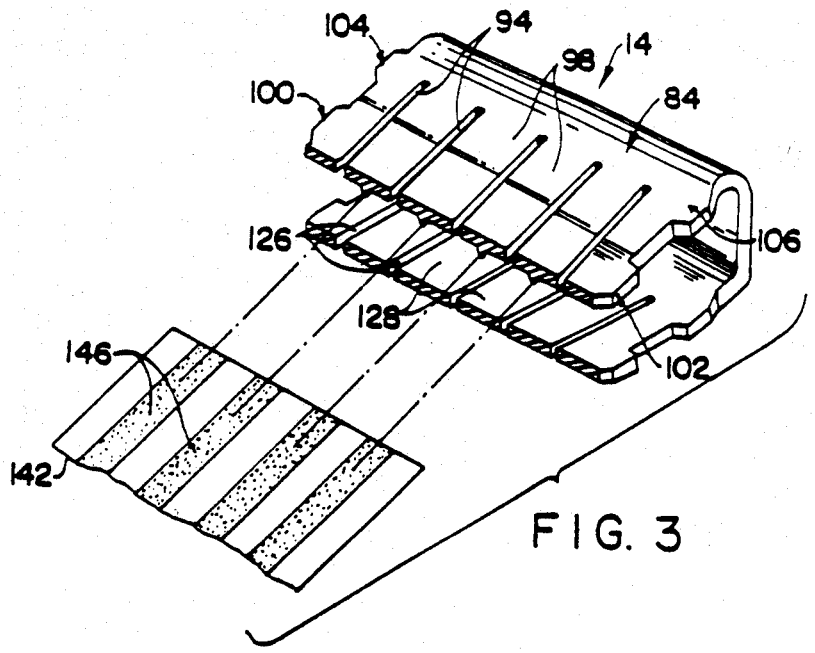
FIG. 3 is a cross-sectional view of the clip of the subject connector taken along line 3—3 of FIG. 1 and further showing a portion of a flat flexible circuit member employed with the subject connector.

As shown in FIGS. 2 and 3, each clamping finger 98 is provided with a contact projection 124 disposed on the portion thereof facing the bottom arm 86 of clip 14. More particularly, the contact projections 124 are disposed at the location on the top arm 84 that is nearest to the bottom arm 86. As shown most clearly in FIG. 3, the contact projections 124 are generally centrally disposed on their respective fingers 98, and will exert pressures in line with the respective contact traces on the flat flexible circuit members.

The bottom arm 86 of the clip 14 is substantially identical to the top arm 84. More particularly, the bottom arm 86 includes a plurality of slits 126 which define independent clamping fingers 128. The bottom arm further includes a pair of leading locking flanges 130 and 132 and a pair of trailing locking flanges 134 and 136 which are substantially identical to the above described locking flanges 100–106.

Figure 4:
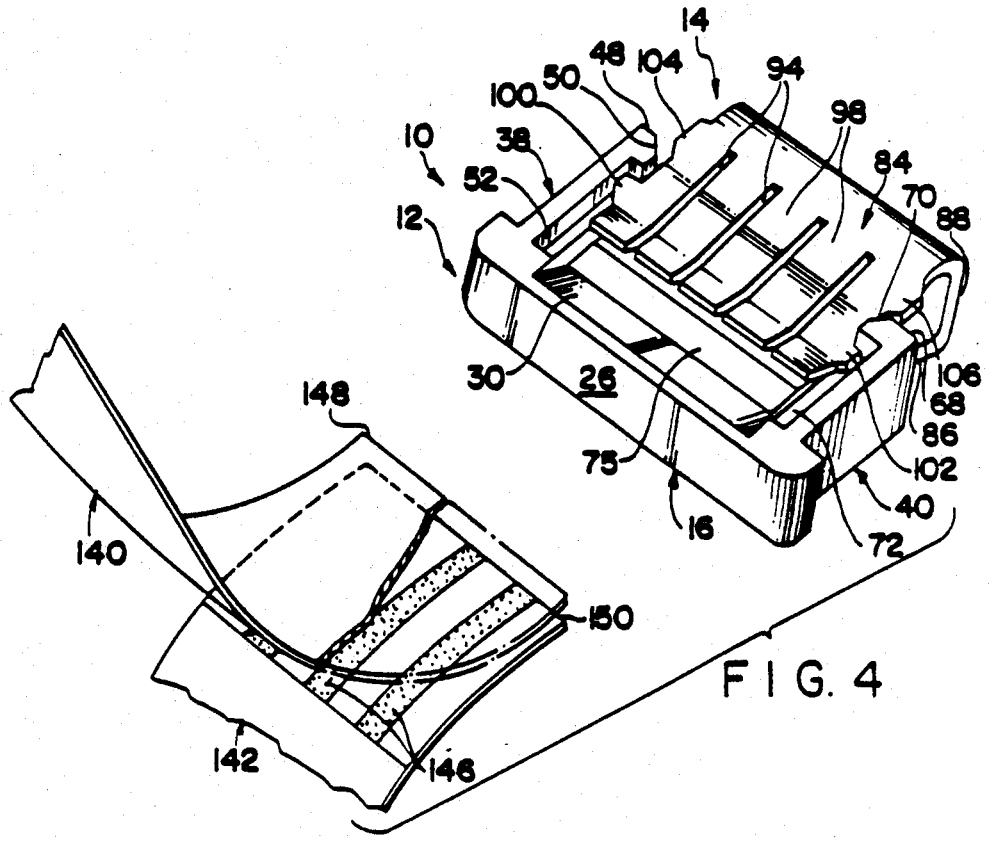
FIG. 4 is a perspective view of the connector in a first assembled condition and in proximity to a pair of flat flexible circuit members.

The connector 10 of the subject invention is assembled by first urging the clip 14 onto the carrier 12 such that the leading clamping flanges 100, 102, 130 and 132 are disposed respectively in the locking recesses 52, 54, 72 and 74. This can be accomplished by biasing the top and bottom arms 84 and 86 away from one another. Preferably, however, the clip 14 is merely urged toward the carrier 12. The contact between the leading cam edges of leading clamping flanges 100, 102, 130 and 132 and the cam surfaces 50 and 70 of guides 38 and 40 will bias the guides 38 and 40 slightly away from one another to permit the leading locking flanges 100, 102, 130 and 132 to enter the respective locking recesses 52, 54, 72 and 74. The perpendicular alignment of the trailing locking edges of the leading locking flanges 100, 102, 130 and 132 will prevent accidental removal of the clip 14 from the carrier 12. This initially seated condition of the clip 14 and the carrier 12 is shown most clearly in FIG. 4.

The two flat flexible circuit members 140 and 142, as shown in FIGS. 3–6 are disposed in face to face contact such that the exposed conductive traces 144 and 146 adjacent the leading ends 148 and 150 are substantially in face to face contact with one another. The two flat flexible circuit members 140 and 142 then are positioned on the cable alignment surface 30 of base 16 and the top surface 76 of support 75. Once the flat flexible circuit members 140 and 142 are properly aligned to the carrier 12, the clip 14 is advanced toward the base 16 of the carrier 12. This movement of the clip 14 will cause the leading cam edges of the trailing locking flanges 104, 106, 134 and 136 to contact the cam surfaces 50 and 70 and urge the guides 38 and 40 slightly away from one another enabling the trailing locking flanges 104, 106, 134 and 136 to advance into the respective locking recesses 52, 72, 54 and 74. This fully seated position is enabled in part by the fact that the width "f" of the clip 14 is equal to or slightly less than the distance "b" between guides 38 and 40, and because the overall length defined by the respective pairs of leading and trailing locking flanges is equal to or slightly less than the respective lengths "d" of the locking recesses 52, 54, 72 and 74.

Figure 5:
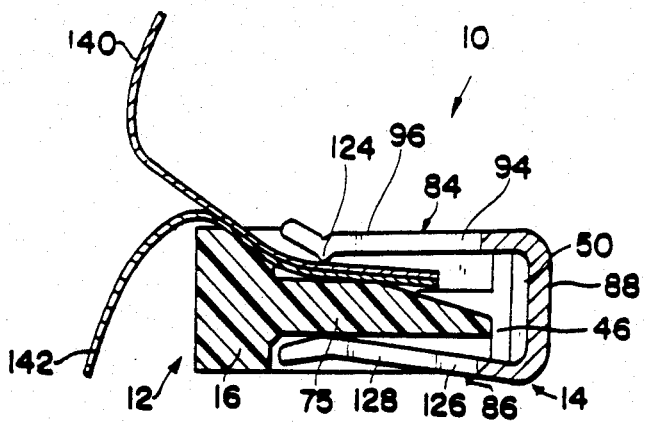
FIG. 5 is a cross-sectional view of a pair of flat flexible circuit members mounted in the connector of the subject invention.
Figure 6:
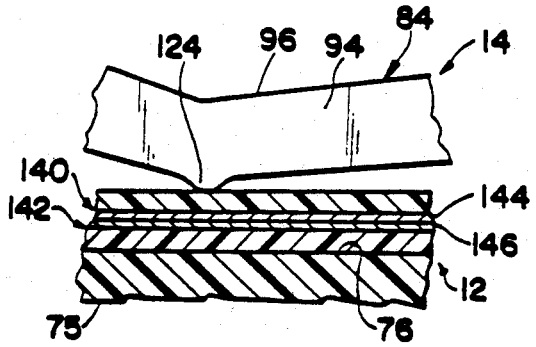
FIG. 6 is a cross-sectional view similar to FIG. 5 but showing greater detail of the flat flexible members.

In the fully seated position, as shown most clearly in FIGS. 5 and 6, the contact projections 124 will be in line with the portion of support 75 having the maximum thickness "e". However, the initial unbiased condition of the clip 14 is such that the distance between the contact projections 124 and the opposite portion of the bottom arm 86 is approximately equal to the thickness "e" of the support 75. Thus, in the condition shown in FIG. 5, the top and bottom arms 84 and 86 of the clip 14 will be biased toward one another and will securely urge the flat flexible circuit members 140 and 142 tightly against one another and against the support 75 of the carrier 12.

The angled alignment of the trailing cam edges of the trailing locking flanges enables the clip 14 to bias the guides 38 and 40 away from one another as the clip 14 is being withdrawn to its partly seated position relative to carrier 12. The connector 10 thus can be used repeatedly.

Figure 7:
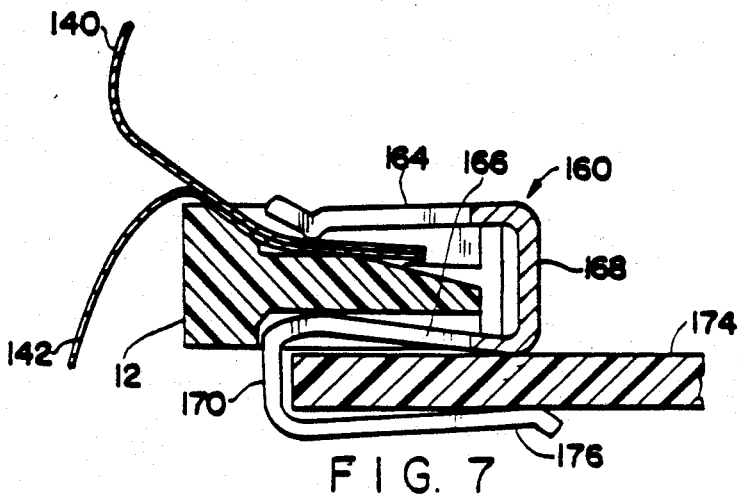
FIG. 7 is a cross-sectional view similar to FIG. 5 but showing an alternate embodiment of the subject connector.

An alternate embodiment of the subject invention is illustrated in FIG. 7. This embodiment incorporates the exact carrier 12 described in detail above, and is employed to connect the flat flexible cables 140 and 142 as described above. However, the clip 160 shown in FIG. 7 differs slightly from the clip 14 shown and described above. In particular, the clip 160 includes an upper arm 164 which is substantially identical to the upper arm 84 of the clip 14 described above. The clip further includes a lower arm 166 which is functionally similar to the lower arm 86 and a connecting member 168 which is substantially identical to the connecting member 88 described above. The lower arm 166 is not a mirror image of the upper arm 164. More particularly, the end of the lower arm 166 opposite the connecting member 168 is integral with a second connecting member 170 which extends generally parallel to the connecting member 168. A mounting clamp 172 extends from the second connecting member 170 and converges generally toward the lower arm 166. The resilient characteristics of the clip 160 enable secure mounting on a circuit board 174 or the like. More particularly, the circuit board 174 is biasingly retained between the lower arm 166 and the clamping arm 172 as shown in FIG. 7.

In summary, a connector is provided for joining two flat flexible circuit members together. The connector comprises a carrier and a clip. The carrier is of unitary construction and preferably is injection molded from a plastic material. The carrier comprises an elongated base, a pair of guides extending orthogonally from opposed ends of the base and a generally planar support extending from the base and disposed intermediate the guides. The guides preferably are provided with locking means. The clip is formed from a resilient material and comprises opposed top and bottom arms which extend from a connecting member and converge toward one another. The arms each include an array of parallel slots defining independent clamping fingers therebetween. The clamping fingers are disposed to align with the conductive traces on the flat flexible circuit members. The clip further comprises locking means engageable with the locking means of the carrier. The connector is employed by positioning the two flat flexible circuit members in face to face relationship such that the conductive traces thereon abut one another. The pair of flat flexible circuit members then are positioned on the support of the carrier, and the clip is urged over the support to securely hold the flat flexible circuit members in face to face relationship with one another and against the support of the carrier. The clip may further comprise a clamping arm to enable the connector to be mounted on a circuit board or the like.

While the invention has been described with respect to certain preferred embodiments, it is apparent that various changes can be made without departing from the scope of the invention as defined by the appended claims.

I claim:

1. A connector for joining a plurality of flat flexible circuit members in face to face contact with one another, said connector comprising:

a carrier comprising a base, a pair of generally spaced apart guides connected to and extending from said base, at least one of said guides including at least one locking recess, and a support connected to and extending from said base and disposed intermediate said guides; and a resilient clip comprising a pair of opposed arms and a connecting member extending therebetween, said clip being dimensioned to be slideably inserted over said support of said carrier and intermediate the guides thereof, said clip including locking means engageable with said locking recess for locking the clip to the carrier, whereby, the flat flexible circuit members may be placed in face to face relationship on the support of the carrier and between the guides thereof and whereby, the clip may be slideably advanced between the guides of the carrier and over the flat flexible circuit members and the support of the carrier to securely hold the flat flexible circuit members in face to face contact with one another and against the support.

2. A connector as in claim 1 wherein the locking means of said clip comprises at least one locking flange engageable with the locking recess of the carrier.

3. A connector as in claim 2 wherein the clip comprises at least one leading locking flange and at least one trailing locking flange, said leading locking flange being disposed on said clip to lock said clip to said carrier in a first relative position for permitting placement of the flat flexible circuit members on the support of the carrier, and wherein the trailing locking flange is disposed on the clip to lock the clip to the carrier in a second relative position for securely holding the flat flexible circuit members in face to face contact with one another and against the support of the carrier.

4. A connector as in claim 1 wherein the guides are spaced from the support.

5. A connector as in claim 4 wherein the carrier is formed from a resilient material to permit limited movement of said guides relative to one another.

6. A connector as in claim 5 wherein said clip comprises cam means for urging said guides of said carrier away from one another to permit slidable movement of said clip between said guides.

7. A connector as in claim 6 wherein the carrier is of unitary construction and is injection molded from a plastic material.

8. A connector as in claim 1 wherein the arms of said clip converge toward one another at locations thereon spaced from said connecting member.

9. A connector as in claim 8 wherein the portions of said arms of said clip most distant from said connecting member converge away from one another to facilitate the mounting of said clip over said support and said flat flexible circuit members.

10. A connector as in claim 1 wherein at least one arm of said clip includes a plurality of slits extending from an edge thereof spaced from said connecting member to a location in proximity to said connecting member such that a plurality of independent clamping fingers are defined by said slits.

11. A connector as in claim 10 wherein each said clamping finger includes a contact projection defining the portion of said clamping finger nearest the other arm of said clip.

12. A connector for electrically connecting two flat flexible circuit members, each said flat flexible circuit member having a leading edge and a pair of parallel side edges, each said flat flexible circuit member further comprising a plurality of spaced apart electrically conductive traces extending generally parallel to the side edges thereof, said electrically conductive traces being exposed in proximity to the leading edge of each flat flexible circuit member, said flat flexible circuit members being disposed in face to face contact such that the electrically conductive traces of one flat flexible circuit member are respectively in contact with the electrically conductive traces of the other flat flexible circuit member, said connector comprising:

a carrier formed from a resilient material and having an elongated base, a pair of parallel guides connected to and extending from said base, said guides being spaced from one another by a distance at least equal to the distance between the side edges of said flat flexible circuit members, each guide further including at least one locking recess, said carrier further including a support extending from said base, said support being intermediate said guides and spaced therefrom; and a resilient clip comprising a connecting member and a pair of opposed arms extending from said connecting member and converging toward one another, the portion of said arms most distant from said connecting member diverging from one another, said arms defining a width less than the distance between the guides of said carrier, said clip further including a pair of opposed locking flanges on at least one of said arms, said locking flanges including angularly aligned cam edges to urge said guides away from each other as the clip is slideably engaged with said carrier, said locking flanges being dimensioned to be received in the locking recesses of said carrier to lockingly retain the clip and the carrier in an assembled condition, whereby the clip may be slideably engaged with said carrier such that the arms resiliently hold the flat flexible circuit members in face to face contact with each other and against the support of the carrier.

13. A connector as in claim 12 wherein each said guide includes a pair of elongated locking recesses and wherein each said arm of said clip includes a pair of leading locking flanges and a pair of trailing locking flanges, said leading locking flanges being disposed at locations on said clip to lock said clip and said carrier together in a first position permitting the placement of the flat flexible circuit members on the support of said carrier, and wherein the trailing locking flanges are disposed at locations on said clip to secure said clip and said carrier in a position relative to one another for securely retaining the flat flexible circuit members against the support.

14. A connector as in claim 13 wherein each trailing locking flange includes at least one cam edge for biasing said guides of said carrier.

15. A connector as in claim 12 wherein the arms of the clip include a plurality of slits extending from edges thereof most distant from said connecting member, said slits defining a plurality of independent clamping fingers.

16. A connector as in claim 15 wherein the clamping fingers of one said clamping arm include a locking projection on the portion thereof closest to the other locking arm.

17. A connector as in claim 12 wherein the clip is formed from a resilient metallic material.

18. A connector as in claim 12 wherein the clip is formed from a resilient plastic material.

* * * * *